United States Patent [19]

Mladota

[11] Patent Number: 5,033,403

[45] Date of Patent: Jul. 23, 1991

[54] COATING APPARATUS FOR WEBS OF MATERIAL

[75] Inventor: John Mladota, Lausanne, Switzerland

[73] Assignee: BemaTec SA, Lausanne, Switzerland

[21] Appl. No.: 438,030

[22] Filed: Nov. 20, 1989

[30] Foreign Application Priority Data

Nov. 18, 1988 [DE] Fed. Rep. of Germany ..... 3839100

[51] Int. Cl.[5] ..... B05C 1/08; B05C 3/18

[52] U.S. Cl. ..... 118/261; 118/401; 118/410; 118/413; 118/419; 118/429

[58] Field of Search ..... 118/407, 410, 411, 413, 118/419, 429, DIG. 15, 249, 250, 261, 258, 259, 401

[56] References Cited

U.S. PATENT DOCUMENTS

| | | | |
|---|---|---|---|
| 2,940,418 | 6/1960 | Penrod et al. . | |
| 3,424,126 | 1/1969 | Mahoney | 118/429 |
| 3,533,833 | 10/1970 | Takahashi et al. | 118/410 |
| 3,645,773 | 2/1972 | Herzhoff et al. | 118/410 |
| 4,396,648 | 8/1983 | Holt et al. | 118/410 |
| 4,491,082 | 1/1985 | Barch et al. | 118/DIG. 15 |
| 4,552,778 | 11/1985 | Zimmer | 118/410 |
| 4,667,879 | 5/1987 | Muller | 239/133 |
| 4,828,779 | 5/1989 | Hiraki et al. | 118/410 |
| 4,867,097 | 9/1989 | Foltz | 118/410 |
| 4,889,072 | 12/1989 | Krimsky | 118/410 |

FOREIGN PATENT DOCUMENTS

| | | | |
|---|---|---|---|
| 459538 | 9/1949 | Canada | 118/410 |
| 804554 | 4/1951 | Fed. Rep. of Germany . | |
| 7101055 | 1/1971 | Fed. Rep. of Germany . | |
| 3232388 | 3/1983 | Fed. Rep. of Germany . | |
| 3447510 | 7/1985 | Fed. Rep. of Germany . | |
| 3309731 | 9/1985 | Fed. Rep. of Germany . | |
| 3506135 | 8/1986 | Fed. Rep. of Germany . | |
| 8804351 | 6/1988 | Fed. Rep. of Germany . | |

*Primary Examiner*—James C. Housel

*Attorney, Agent, or Firm*—Sughrue, Mion, Zinn, Macpeak & Seas

[57] ABSTRACT

An apparatus for applying a thin layer of a coating material (2) to a web of material (4) passing over a counter-pressure roller (3), with a slot nozzle device (1) includes a vertical nozzle box (5) with an upper nozzle slot (7) between inlet (8) and outlet (9) nozzle lips and a laterally mounted storage tank (6) for coating material (2). In order to keep the layer thickness the same and without coating flaws and thickened edges according to the operating speed and fluctuations in thickness of the web of material (4), the storage tank (6) is mounted on the nozzle box (5) in such a way that the liquid level of the coating material (2) in the storage tank (6) and in the nozzle box (5) is essentially the same. Furthermore, appropriately in the nozzle box (5) is provided a driven continuous conveyor roller (10) mounted eccentrically in a roller chamber (11) in the path of the coating material (2).

5 Claims, 3 Drawing Sheets

COATING APPARATUS FOR WEBS OF MATERIAL

BACKGROUND OF THE INVENTION

The invention relates to an apparatus for applying a thin layer of a coating material to a web of material passing over a counter-pressure roller, with a slot nozzle device, which comprises a vertical nozzle box with a wide upper nozzle slot between inlet and outlet nozzle lips and a storage tank for coating material mounted laterally on the nozzle box. In a coating apparatus of this kind, the thickness of the layer applied is essentially determined by the distance between the outlet nozzle lip and the web of material or counter-pressure roller.

SUMMARY OF THE INVENTION

It is the object of the invention to provide a coating apparatus of the kind described hereinbefore, in which the layer thickness remains constant irrespective of fluctuations in thickness of the web of material and the momentary operating speed, without coating flaw and thickened edges.

The basis of this is that firstly the physical properties of the layer change in case of fluctuations in thickness, and that secondly the annual consumption of coating material in case of fluctuations in the layer thickness increases considerably for reasons of the guarantee of production.

According to the invention, the object of the invention is achieved with an apparatus of the kind described hereinbefore by the fact that the storage tank is mounted on the nozzle box and connected thereto in such a way that the liquid level of the coating material in the storage tank is essentially the same as that in the nozzle box due to the effect of vessels communicating with each other, and that in the nozzle box below the nozzle slot is provided a driven continuous conveyor roller which extends over the length of the nozzle box and which is mounted eccentrically in a roller chamber in the path of the coating material, wherein the level of stationary coating material is below, preferably about 2–3 cm below the outlet of the nozzle slot.

In the coating apparatus according to the invention, a hydrodynamic liquid pressure is built up in the coating material against the counter-pressure roller or the web of material to be coated, in particular due to rotation of the continuous conveyor roller. In this case sufficient coating material is supplied to the web of material to be coated or counter-pressure roller at the minimum possible pressure. The required layer thickness is adjusted exclusively by the distance between the outlet nozzle lip and web of material or the counter-pressure roller.

Long-standing experience with a large number of coating nozzles with built-in positive-displacement pump has shown that coating material may only be deposited but not pumped onto webs of material or counter-pressure rollers, as any pump pressure is superimposed on the processes in the coating nip and leads to fluctuations in layer thickness with the slightest geometrical deviations in the nozzle and roller nip. Furthermore coating flaws were produced at too low a pressure, and the edges were built up at too high a pressure.

This correlation became particularly clear with natural rubber adhesives which were filled with various iron oxides. The superimposed pressure arising from the pump had two effects:

1. rubber and iron oxide separated, which produced light and dark adhesive lines on a transparent film, and
2. with even greater superimposed pressure, the coating surface acquired a herringbone pattern.

With the apparatus according to the invention, the moving web of material or counter-pressure roller entrains coating material by adhesion from the nozzle slot and forms a pressure cushion between the outlet nozzle lip and the counter-pressure roller. This pressure cushion formed naturally as a result of the speed and viscosity of the coating material is maintained but not essentially affected by the supply of coating material.

Advantageously, above the continuous conveyor roller is provided an outlet chamber extending over the length of the nozzle box, and adjoining same a narrow feed slot leading to the wide nozzle slot.

In order to be able to set any different coating widths, advantageously in the nozzle slot are provided, in the region of both ends thereof, axially displaceable slide valves for selectively covering the nozzle slot.

If these slide valves are displaced to cover the nozzle slot in such a way that a narrower web of material is coated, for example, over half the nozzle length, the coating material accumulates beneath the covered zones. As however the continuous conveyor roller does not generate any significant pump pressure, the back pressure remains very low, and a build-up by excess coating material at the coating edges is completely eliminated.

The coating nip, formed by the outlet nozzle lip and the counter-pressure roller, should be a high-precision nip. Advantageously, therefore, the counter-pressure roller is a very finely polished, chromium-plated steel roller with truth of running of about 2–3 μm, while the outlet nozzle lip is designed very straight with a linearity deviation of less than 1 μm over a length of 100 mm.

Appropriately, the inlet nozzle lip is coated with an elastic material on the side facing towards the counter-pressure roller.

Furthermore, advantageously the outlet nozzle lip and/or the inlet nozzle lip are arranged interchangeably in the nozzle box.

Completely uniform coating of a web of material passing over the counter-pressure roller directly from the nozzle slot is possible only if the web of material is very constant in thickness and practically without differences in thickness affecting the layer thickness. This is the case with, for example, calendered papers, various plastic films, biaxially oriented polypropylene films and the like.

For webs of materials with great fluctuations in thickness, for example 7–9 μm in the direction of the web and at short intervals, indirect coating must therefore be used. This is particularly true of thin coating materials, as these follow the unevenness of the web of material. In case of coating materials with higher viscosities, the inertia of the compound has a levelling effect; the fluctuations of the coating are in any case less than the fluctuations in thickness of the web of material.

For this there is advantageously provided a pressure roller which is driven in the same or opposite direction to the counter-pressure roller and over which the web of material is guided in contact with the counter-pressure roller which is proportionately precoated by the slot nozzle device and works as an applicator roller.

Appropriately, the contact pressure of the pressure roller against the counter-pressure roller is variable by adjustable stops. In this case the coating is first applied directly to the counter-pressure roller with high precision. The web of material in this case runs over the pressure roller, where the pre-proportioned layer is taken from the counter-pressure roller onto the web of material in counter-rotation or rotation in the same direction.

Furthermore, the nozzle box can advantageously be opened easily at a plane passing through the vertical centre longitudinal plane of the nozzle slot. This results in essential simplification and user-friendliness when cleaning the slot nozzle device on changing the coating material, in particular in connection with a frequent change of batch.

Finally, appropriately the storage tank and/or the nozzle box can be heated.

BRIEF DESCRIPTION OF THE INVENTION

The invention is explained in more detail below by practical examples and with reference to drawings. The drawings show:

FIG. 1 a partial front view of an apparatus according to the invention for direct coating, partly in section, FIG. 2 a partial side view of the apparatus according to FIG. 1, and FIG. 3 a partial front view of an apparatus according to the invention for indirect coating, partly in section.

DETAILED DESCRIPTION OF THE INVENTION

Figure 1:
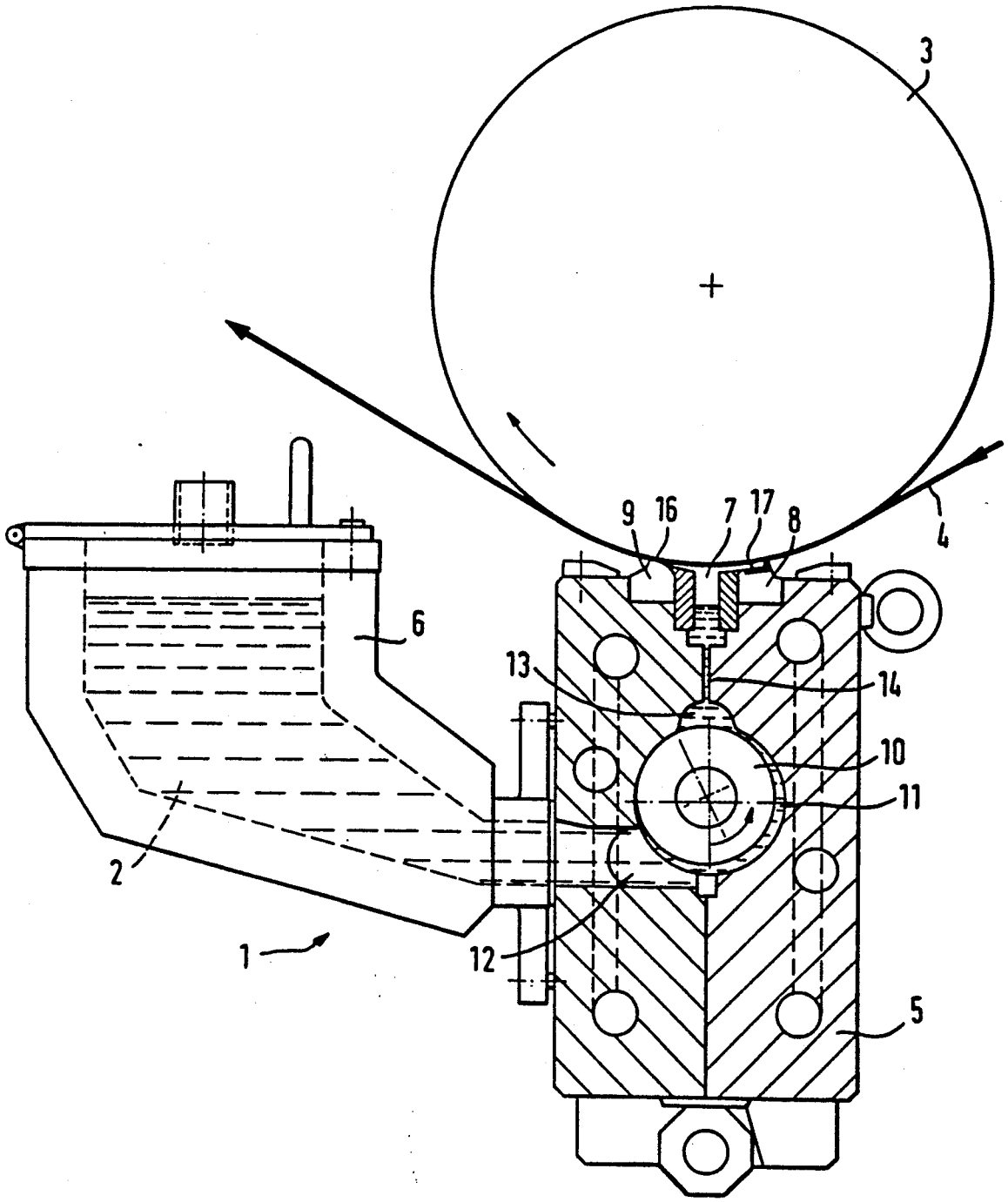

FIG. 1 shows schematically a slot nozzle direct 1 for applying a thin layer of a coating material 2 directly to a web of material 4 passing over a counter-pressure roller 3. The slot nozzle device consists of a vertical nozzle box 5 and a storage tank 6 for coating material 2 mounted laterally on the nozzle box 5. The nozzle box 5 has at its upper end a wide nozzle slot 7 between an inlet nozzle lip 8 and an outlet nozzle lip 9. The coating material 2 is deposited through the wide nozzle slot 7 directly onto the web of material 4.

The storage tank 6 is mounted on the nozzle box 5 and connected thereto in such a way that the liquid level of the coating material 2 in the storage tank 6 and in the nozzle box 5 is essentially the same due to the effect of vessels communicating with each other.

In the nozzle box 5, below the nozzle slot 7 is provided a driven continuous conveyor roller 10 extending over the length of the nozzle box 5. The continuous conveyor roller 10 is mounted eccentrically in a roller chamber 11 in the path of the coating material 2 from the nozzle box 5 to the nozzle slot 7. The level of stationary coating material 2 is below, preferably 2-3 cm below the outlet of the nozzle slot 7.

The continuous conveyor roller 10 is built in one or more sections and held together with two bearing rollers by a connecting rod. It can be retracted axially as a whole from the nozzle box 5.

Beneath the continuous conveyor roller 10 or roller chamber 11 is provided an inlet chamber 12 extending over the length of the nozzle box 5. Above the continuous conveyor roller 10 is located an outlet chamber 13 extending over the length of the nozzle box 5, and adjoining same a narrow feed slot 14 leading to the wide nozzle slot 7.

By rotation of the continuous conveyor roller 10, a hydrodynamic liquid pressure is built up aganist the counter-pressure roller 3 or the web of material 4 to be coated. At the same time sufficient coating material 2 is supplied to the web of material 4 to be coated, at the minimum possible pressure. The required layer thickness is set exclusively by the distance between the outlet nozzle lip 9 and the web of material 4 or the counter-pressure roller 3. The moving web of material 4 entrains coating material 2 by adhesion from the nozzle slot 7 and forms a pressure cushion between the outlet nozzle lip 9 and the counter-pressure roller 3. This pressure cushion formed naturally as a result of the speed and viscosity of the coating material 2 is maintained but not essentially affected by the supply of coating material.

A selection of coating materials which can be processed with the apparatus according to the invention and the processing parameters and resulting end products thereof is given in Table 1 below.

Figure 2:
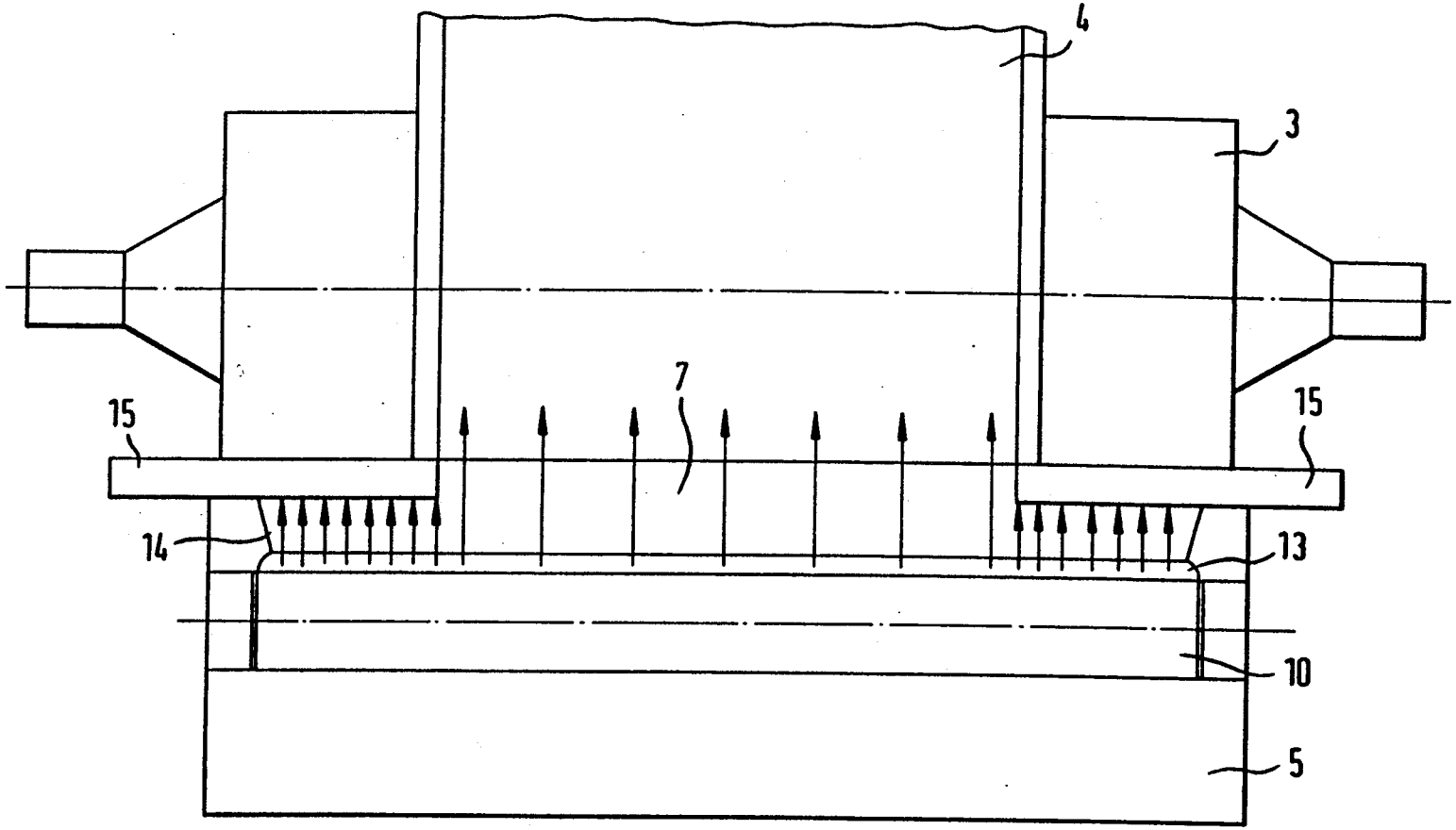

In order to be able to set any different coating widths, in the nozzle slot 7 are provided, in the region of both ends thereof, axially displaceable slide valves 15 for selectively covering the nozzle slot, cf. in particular FIG. 2. If these slide valves 15 are displaced to cover the nozzle slot in such a way that a narrower web of material 4 is coated, for example, over half the nozzle length, the coating material accumulates beneath the covered zones. As however the continuous conveyor roller 10 does not generate any significant pump pressure, the back pressure remains very low, and a build-up by excess coating material 2 at the coating edges is completely eliminated.

The coating nip 16, formed by the outlet nozzle lip 9 and the counter-pressure roller 3, should be a high-precision nip. Advantageously, therefore, the counter-pressure roller 3 is a very finely polished, chromium-plated steel roller with truth of running of about 2-3 μm, while the outlet nozzle lip 9 is designed very straight with a linearity deviation of less than 1 μm over a length of 100 mm.

The inlet nozzle lip 8 can be coated with an elastic material 17 on the side facing towards the counter-pressure roller 3.

TABLE 1

| Industrial coating material | End product | Viscosity range mPas | Solvent | General dry weight | Application temperature |
|---|---|---|---|---|---|
| natural rubber adhesive | adhesive tape | 60000-800000 | toluene-hexane | 18-22 g/m² | room temperature |
| PU compounds | clothing insulation | 2000-8000 | MEK | 20-30 g/m² | room temperature |
| PVC pastes | artificial leather | 4000-20000 | — | 300-400 g/m² | room temperature |
| PVC lacquer | cover foil aluminium | 2000-12000 | MEK | 6-8 g/m² | room temperature |
| acrylic dispersion | labels | 200-1200 | water | 18-22 g/m² | room temperature |
| SBS dispersion | labels | 200-1200 | water | 18-22 g/m² | room temperature |
| starch adhesive | wet adhesive tape, prepasted wallpapers | 30000-50000 | water | 15-40 g/m² | 80° C. |
| EVA coating hot melts | barrier layers for wrappers | 2000-12000 | — | 10-25 g/m² | 170° C. |
| EVA lining hot melts | barrier layers for bags | 2000-50000 | — | 20-35 g/m² | 170° C. |
| atactic polypropylene | barrier layers for soap powder | 200-1200 | — | 35-45 g/m² | 190° C. |

TABLE 1-continued

| Industrial coating material | End product | Viscosity range mPas | Solvent | General dry weight | Application temperature |
|---|---|---|---|---|---|
| | boxes and wrapping paper for paper rolls | | | | |
| bitumen | paper bags | 100–1200 | — | 15–18 g/m$^2$ | 190° C. |
| fusion adhesive | labels, adhesive tape | 20000–70000 | — | 17–35 g/m$^2$ | 180° C. |

This results in very good sealing of the coating material 2 in the region of the inlet nozzle lip 8.

Further, advantageously the outlet nozzle lip 9 and/or the inlet nozzle lip 8 are constructed in such a way that they can be arranged interchangeably in the nozzle box 5. Particularly advantageously, these two nozzle lips 8 and 9 are even mounted mutually interchangeably. If a very thin coating is to be applied, either the direction of rotation of the counter-roller 3 can be reversed in such a way that the inlet nozzle lip 8 coated with the elastic material 17 becomes the outlet nozzle lip. The elastic material 17 can be pressed directly against the counter-roller 3 and thus determines with high precision the thickness of application of the very thin coating. On the other hand, with a constant direction of rotation of the counter-pressure roller 3 the inlet nozzle lip 8 and the outlet nozzle lip 9 can be interchanged with each other, to obtain the same effect.

Figure 3:
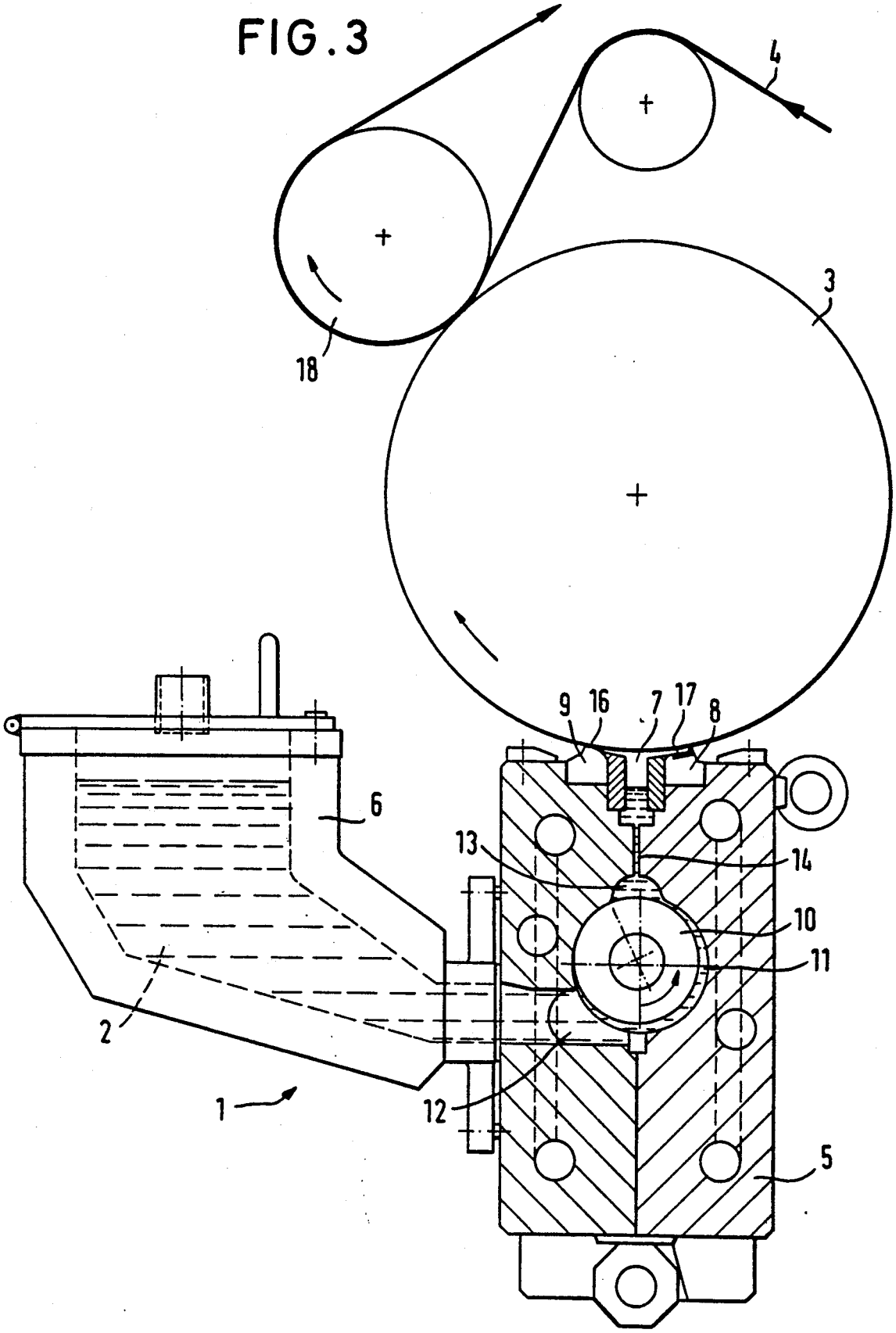

For webs of material with great fluctuations in thickness, for example 7–9 μm in the direction of the web and at short intervals, advantageously so-called indirect coating must be used. An apparatus for this is shown schematically in FIG. 3. The counter-pressure roller 3 here works as an applicator roller to which the coating material 2 is applied directly proportioned by the slot nozzle device 1 in a precoating process. In this case there is provided a pressure roller 18 over which the web of material 4 is guided in contact with the counter-pressure roller 3 which is proportionately precoated. At the point of contact, the coating material 2 is taken from the counter-pressure roller 3 uniformly onto the web of material 4.

In most cases the pressure roller 18 is driven in the opposite direction to the counter-pressure roller 3, but if occasion arises in the same direction. The contact pressure of the pressure roller 18 against the counter-pressure roller 3 is advantageously variable by adjustable stops, not shown.

The nozzle box 5 can advantageously be opened easily at a plane passing through the vertical centre longitudinal plane of the nozzle slot 7. In this case advantageously the portion of the nozzle box 5 remote from the storage tank 6 can be pivoted away. This results in essential simplification and user-friendliness when cleaning the slot nozzle device 1 on changing the coating material 2, in particular in connection with a frequent change of batch.

Finally, the storage tank 6 and/or the nozzle box 5 can be heated, which is particularly considered for application temperatures of the coating materials 2 above room temperature.

What is claimed is:

1. A coating apparatus for a web of material comprising a vertically disposed nozzle box having an elongated nozzle slot on an upper surface thereof, spaced apart inlet and outlet nozzle lips disposed in said slot, and adapted to cooperate with a counter-pressure roller having an axis of rotation parallel to said slot, an elongated cylindrical roller chamber located in said box below said slot in spaced parallel relation thereto, a single elongated driven roller eccentrically mounted in said roller chamber for rotation therein, first passage means connecting said roller chamber with said slot, a storage tank connected to one side of said nozzle box, second passage means connecting said storage tank with said roller chamber whereby coating material can be maintained in said nozzle box below said slot at a level equal to a level of coating material in said tank when said roller is not rotated and upon rotation of said roller, coating material in said box is adapted to be raised into contact with said counter-pressure roller, and an elongated outlet chamber coextensive in length with said roller chamber is disposed in said box in communication between said roller chamber and said first passage means with said first passage means being narrower than said slot, said roller chamber and said outlet chamber.

2. A coating apparatus according to claim 1, wherein displaceable slide valves are disposed in said nozzle slot between said lips for selectively covering said nozzle slot upon movement lengthwise of said slot.

3. A coating apparatus according to claim 1, wherein said outlet nozzle lip has a linear deviation of less than 1 MM over a length of 100 MM.

4. A coating apparatus according to claim 1, wherein said inlet nozzle lip is coated with an elastic material on a side adapted to face towards a counter-pressure roller.

5. A coating apparatus according to claim 1, wherein said outlet nozzle lip and said inlet nozzle lip are mounted interchangeably with respect to each other in said nozzle slot.

* * * * *